United States Patent [19]

Monbaliu et al.

[11] Patent Number: 5,043,238

[45] Date of Patent: Aug. 27, 1991

[54] PHOTOSENSITIVE RECORDING MATERIAL SUITED FOR USE IN ELECTROPHOTOGRAPHY CONTAINING DIHYDROQUINOLINE CHARGE TRANSPORT COMPOUNDS

[75] Inventors: Marcel J. Monbaliu, Mortsel; David R. Terrell, Lint; Stefaan K. De Meutter, Zandhoven, all of Belgium

[73] Assignee: Agfa-Gevaert, N.V., Mortsel, Belgium

[21] Appl. No.: 495,160

[22] Filed: Mar. 19, 1990

[30] Foreign Application Priority Data

Mar. 20, 1989 [EP] European Pat. Off. ... EP89200707.1

[51] Int. Cl.[5] ..... G03G 5/14

[52] U.S. Cl. ..... 430/59; 430/58; 430/60; 546/176; 546/178; 546/180

[58] Field of Search ..... 430/59, 58, 60; 546/178, 176, 180

[56] References Cited

U.S. PATENT DOCUMENTS 4,943,502 7/1990 Terrell et al. ..... 546/180

*Primary Examiner*—David Welsh
*Assistant Examiner*—S. Rosasco
*Attorney, Agent, or Firm*—Breiner & Breiner

[57] ABSTRACT

An electrophotographic recording material which comprises an electrically conductive support having coated thereon a layer containing at least one 1,2-dihydroquinoline compound according to one of the general formulae (I) or (II) disclosed in the description.

10 Claims, No Drawings

PHOTOSENSITIVE RECORDING MATERIAL SUITED FOR USE IN ELECTROPHOTOGRAPHY CONTAINING DIHYDROQUINOLINE CHARGE TRANSPORT COMPOUNDS

DESCRIPTION

The present invention relates to a photosensitive recording material suitable for use in electrophotography.

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material the photoconductive recording material is reusable. In order to permit a rapid multiple printing or copying a photoconductor layer has to be used that rapidly looses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

Another important property which determines whether or not a particular photoconductive material is suitable for electrophotographic copying is its photosensitivity that must be high enough for use in copying apparatus operating with fairly low intensity light reflected from the original.

Commercial usefulness further requires that the photoconductive layer has a chromatic sensitivity that matches the wavelength(s) of the light of the light source, e.g. a laser or has panchromatic sensitivity when white light is used e.g. to allow the reproduction of all colours in balance.

Intensive efforts have been made to satisfy said requirements, e.g. the spectral sensitivity of selenium has been extended to the longer wavelengths of the visible spectrum by making alloys of selenium, tellurium and arsenic. In fact selenium-based photoconductors remained for a long time the only really useful photoconductors although many organic photoconductors had been discovered.

Organic photoconductor layers of which poly(N-vinylcarbazole) layers have been the most useful were less interesting because of lack of speed, insufficient spectral sensitivity and rather large fatigue.

However, the discovery that 2,4,7-trinitro-9-fluorenone (TNF) in poly(N-vinylcarbazole) (PVCz) formed a charge-transfer complex with strongly improved photosensitivity (ref. U.S. Pat. No. 3,484,237) has opened the way for the use of organic photoconductors in copying machines that could compete with the selenium-based machines.

TNF acts as an electron acceptor whereas PVCz serves as electron donor Films consisting of said charge transfer complex with TNF:PVCz in 1:1 molar ratio are dark brown, nearly black and exhibit high charge acceptance and low dark decay rates. Overall photosensitivity is comparable to that of amorphous selenium (ref. Schaffert, R. M. IBM J. Res. Develop., 15, 75 (1971).

A further search led to the discovery of phthalocyanine-binder layers, using poly(N-vinylcarbazole) as the binder [ref. Hackett, C. F., J. Chem. Phys., 55, 3178 (1971)]. The phthalocyanine was used in the metal-free X form and according to one embodiment applied in a multilayer structure wherein a thin layer of said phthalocyanine was overcoated with a PVCz layer. Hackett found that photoconductivity was due to field dependent photogeneration of electron-hole pairs in the phthalocyanine and hole injection into the PVCz. The transport of the positive charges, i.e. positive hole conduction proceeded easily in the PVCz layer. From that time on much research has been devoted to developing improved photoconductive systems wherein charge generation and charge transport materials are separate in two contiguous layers (see e.g. U.K. Pat No. 1,577,859). The charge generating layer may be applied underneath or on top of the charge transport layer. For practical reasons, such as less sensitivity to wear and ease of manufacture, the first mentioned arrangement is preferred wherein the charge generating layer is sandwiched between a conductive support and a light transparent charge transport layer (ref. Wolfgang Wiedemann. Organische Photoleiter - Ein Uberblick. II, Chemiker Zeitung, 106. (1982) Nr. 9 p. 315).

In order to form a photoconductive two layer-system with high photosensitivity to visible light dyes having the property of photo-induced charge generation have been selected. Preference is given to a water-insoluble pigment dye e.g. of one of the following classes:

a) perylimides, e.g. C.I. 71 130 (C.I.=Colour Index) described in DBP 2 237 539,
b) polynuclear quinones, e.g. anthanthrones such as C.I. 59 300 described in DBP 2 237 678,
c) quinacridones, e.g. C.I. 46 500 described in DBP 2 237 679,
d) naphthalene 1,4,5,8-tetracarboxylic acid derived pigments including the perinones, e.g. Orange GR. C.I. 71 105 described in DBP 239 923.
e) phthalocyanines, e.g. $H_2$-phthalocyanine in X-crystal form (X-$H_2$Ph), metal phthalocyanines, e.g. CuPc C.I. 74 160 described in DBP 2 239 924 and indium phthalocyanine described in U.S. Pat. No. 4,713.312,
f) indigo- and thioindigo dyes. e.g. Pigment Red 88, C.I 73 312 described in DBP 2 237 680,
g) benzothioxanthene-derivatives as described e.g. in DAS 2 355 075,
h) perylene 3,4,9,10-tetracarboxylic acid derived pigments including condensation products with o-diamines as described e.g. in DAS 2 314 051,
i)polyazo-pigments including bisazo-, trisazo- and tetrakisazo-pigments, e.g. Chlordiane Blue C.I. 21 180 described in DAS 2 635 887, and bisazopigments described in DOS 2 919 791, DOS 3 026 653 and DOS 3 032 117, j) squarilium dyes as described e.g. in DAS 2 401 220, k) polymethine dyes.

l) dyes containing quinazoline groups, e.g. as described in GB-P 1 416 602 according to the following general formula:

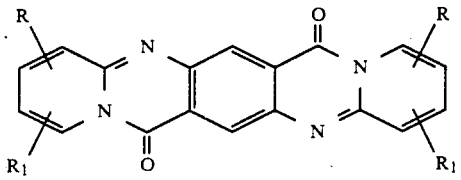

in which R and $R_1$ are either identical or different and denote hydrogen, $C_1$–$C_4$ alkyl, alkoxy, halogen, nitro or hydroxyl or together denote a fused aromatic ring system, m) triarylmethane dyes, and n) dyes containing 1,5 diamino-anthraquinone groups.

The charge transporting layer can comprise either a polymeric material or a nonpolymeric material. In the case of nonpolymeric materials the use of such materials with a polymeric binder is generally preferred or required for sufficient mechanical firmness and flexibility. This binder may be "electronically inert" (that is incapable of substantial transport of at least one species of charge carrier) or can be "electronically active" (capable of transport of that species of charge carriers that are neutralized by a uniformly applied electrostatic charge). For example, in the arrangement: conductive support—charge generating layer—charge transport layer, the polarity of electrostatic charging that gives the highest photosensitivity to the arrangement has to be such that negative charging is applied to a hole conducting (p-type) charge transport layer and positive charging is applied to an electron conducting (n-type) charge transport layer.

Since most of the organic pigment dyes of the charge generating layer provide more efficient hole injection than electron injection across a field-lowered barrier at the interface where pigment-dye/charge transport compounds touch each other and possibly form a charge transfer complex there is a need for charge transport materials that have a good positive hole transport capacity for providing an electrophotographic recording system with low fatigue and high photosensitivity.

According to the already mentioned article "Organische Photoleiter—Ein Uberblick. II of Wolfgang Wiedemann. p. 321, particularly efficient p-type transport compounds can be found in the group consisting of heteroaromatic compounds.

The use of particular photoconductive 1,2-dihydroquinoline compounds and 1,2,3,4-tetrahydroquinoline compounds in single layer photoconductive materials is described in U.S. Pat. Nos. 3,832,171, 3,830,647 and 3,798,031.

It is an object of the present invention to provide novel 1,2-dihydro-quinoline compounds that are particularly useful in the production of electrophotographic recording materials.

It is a further object of the present invention to provide electrophotographic recording materials containing said novel 1,2-dihydro-quinoline compounds in a single photoconductive layer.

It is a special object of the present invention to provide an electrophotographic composite layer material comprising a charge generating layer in contiguous relationship with a charge transport layer wherein said charge transport layer contains 1,2-dihydroquinoline compounds that haves a particularly high p-type charge transport capacity.

It is another object of the present invention to provide a recording process wherein said composite layer material is uniformly electrostatically charged and the charge generating layer in contiguous relationship with said charge transport layer containing said photoconductive 1,2-dihydroquinoline compounds is exposed imagewise whereby a latent electrostatic charge pattern is formed.

Other objects and advantages of the present invention will appear from the further description and examples.

In accordance with the present invention novel 1,2-dihydroquinoline compounds are provided that correspond to one of the following general formulae (I) or (II):

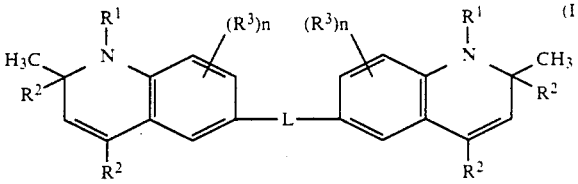

(I)

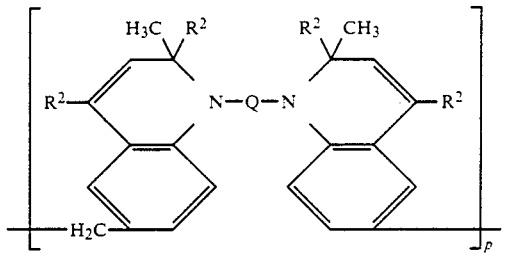

(II)

wherein:

$R^1$ represents hydrogen or a $C_1$–$C_6$ alkyl group in linear or branched form, including said alkyl group carrying one or more substituents selected from the group consisting of aryl, cyano, an ether group, a thioether group, a tertiary amino group, halogen or a heterocyclic group, $R^2$ represents a $C_1$–$C_6$ alkyl group in linear or branched form, e.g. methyl, an aralkyl group, e.g. benzyl, or an aryl group, e.g. phenyl, $R^3$ represents a $C_1$–$C_4$ alkyl group, an aralkyl group, an aryl group, an alkoxy group or halogen.

n is zero, 1 or 2, and

L is a chemical bond or a bivalent connecting group represented by the following formula :

$$—(—X—)_k—(—Z—)_l—(—Y—)_m—$$

in which each of X and Y independently from each other represents, $NR^4$, $CHR^4$, CH=N, N=CH, N=N, CH=CH, $CH_2NR^4$, $C{=}NR^4$, $C{=}CHR^4$, O—$CH_2$, O,S,

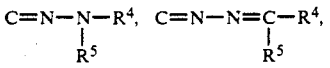

in which each of $R^4$ and $R^5$ (same or different) represents hydrogen, an alkyl group, an aryl group or a heterocyclic group, e.g. a 1,2-dihydroquinolyl group, including these groups in substituted form, Z represents O, S, C=O, $SO_2$, alkylene, aryl-substituted alkylene, heteryl-substituted alkylene, a cycloalkylene group, an arylene group, a bivalent heterocyclic group or a C=N—N(aryl)$_2$ group, and k, l, and m each represent l, or one or two of them represent zero, Q is a bivalent aliphatic or bivalent cycloaliphatic group, e.g. of the type that can be introduced by alkylation, e.g. an alkylene group, preferably an ethylene group, a substituted alkylene group or an alkylene chain interrupted by a bivalent aromatic group, e.g. a phenylene, naphthalene or anthracene group, or a bivalent aliphatic group wherein at least two carbon atoms are linked through a hetero-atom selected from the group consisting of oxygen, sulphur or nitrogen wherein nitrogen is substituted with a monovalent hydrocarbon group, e.g. an aryl group, and p is a positive integer being at least two, e.g. 2 to 200.

By "heteryl" is meant a monovalent C-linked heterocyclic group.

Specific examples of 1,2-dihydroquinoline charge transport (CTC) compounds according to general formula (I) are listed in the following Table 1 with their melting point (mp).

TABLE 1

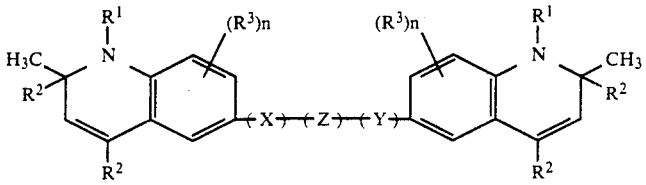

| CTC No. | $R^1$ | $R^2$ | $R^3$ | n | X | Z | Y | mp °C. |
|---|---|---|---|---|---|---|---|---|
| 1 | $CH_3$ | $CH_3$ | — | 0 | — | $CH_2$ | — | 124 |
| 2 | $CH_3$ | $CH_3$ | — | 0 | — | CH-phenyl | — | 169 |
| 3 | $CH_3$ | $CH_3$ | — | 0 | — | ethylene | — | 121 |
| 4 | $CH_3$ | $CH_3$ | 7-$CH_3$ | 1 | — | $CH_2$ | — | 124 |
| 5 | $CH_3$ | $CH_3$ | 7-$CH_3$ | 1 | — | CH-phenyl | — | 157 |
| 6 | $CH_3$ | $CH_3$ | 7-$CH_3$ | 1 | — | CH-Q' | — | 191 |
| 7 | H | $CH_3$ | 7-Cl | 1 | — | CH-phenyl | — | 201 |
| 8 | H | $CH_3$ | — | 1 | — | $CH_2$ | — | 160 |
| 9 | $CH_3$ | $CH_3$ | — | 0 | CH=N | phenylene | N=CH | 225 |
| 10 | $CH_3$ | $CH_3$ | — | 0 | $CH_2$—NH | phenylene | NH—$CH_2$ | 185 |
| 11 | $CH_3$ | $CH_3$ | — | 0 | C=Q1 | — | — | 68 |
| 12 | $CH_3$ | $CH_3$ | — | 0 | CH=CH | C=Q2 | CH=CH | 156 |
| 13 | $CH_3$ | $CH_3$ | — | 0 | — | C=O | — | 153 |
| 14 | $CH_3$ | $CH_3$ | — | 0 | CQ3 | N—N | CQ3 | 170 |
| 15 | $CH_3$ | $CH_3$ | — | 0 | CH=CH | C=O | CH=CH | 75 |
| 16 | H | $CH_3$ | — | 0 | — | ethylene | — | 200 |
| 17 | $CH_3$ | $CH_3$ | — | 0 | O | ethylene | O | 152 |
| 18 | $CH_3$ | $CH_3$ | — | 0 | O=$CH_2$ | phenylene | O—$CH_2$ | 128 |
| 19 | $C_2H_5$ | $CH_3$ | — | 0 | CH=CH | phenylene | CH=CH | 204 |
| 20 | $CH_3$ | $CH_3$ | — | 0 | CH=CH | Q4 | CH=CH | 245 |

Herein Q' represents N-ethyl-carbazol-3-yl, Q1 represents

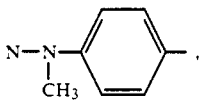

Q2 represents

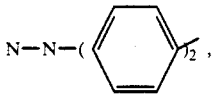

and Q3 represents 1,2-dihydro-1,2,2,2,4-tetramethylquinolin-6-yl Q4 represents (p-phenylene)—CH=CH—(p-phenylene).

The melting point of preferred positive charge transport compounds is at least 100° C. to prevent marked softening of the charge transport layer and thermodiffusion of said compounds out of the recording material.

Particularly useful photographic results are obtained with 1,2-dihydroquinoline compounds according to the above general formula (I) wherein —$(X)_k$— is —CH-$R^4$— and l and m are both zero.

The preparation of some of the 1,2-dihydroquinolines of said Table 1 and of other compounds according to the above general formula (I) is given hereinafter for illustrating their synthesis.

Preparation of Compound 1

A mixture of 93.5 g (0.5 mole) of 1,2-dihydro-1,2,2,4-tetramethyl-quinoline, 131,3 ml of a 40% wt aqueous solution of formaldehyde, 7 ml of 5N hydrochloric acid and 500 ml of water was heated at 80° C. for 6 h. The precipitate obtained was separated by filtration, stirred in aqueous ammonia and separated again whereupon it was washed till neutral with water. After drying the product obtained was recrystallized from ethanol. Yield 48 g. Melting point 124° C.

Preparation of Compound 6

A mixture of 30.15 g (0.15 mole) of 1,2-dihydro-1,2,2,4,7-pentamethyl-quinoline, 8.10 g (0.075 mole) of benzaldehyde, 0.01 ml of methanesulphonic acid and 30 ml of pentanol was boiled under reflux while removing the water produced in the reaction by azeotropic distillation. After two hours of refluxing the reaction mixture was poured into methanol and the precipitate obtained was filtered off. After drying the product obtained was purified by column chromatography and finally recrystallized from n-hexane. Yield: 25.7 g. Melting point: 157° C.

Preparation of Compound 7

A mixture of 28.1 g (0.14 mole) of 1,2-dihydro-1,2,2,4-7-pentamethyl-quinoline, 15.6 g (0.07 mole) of N-ethyl-3-formylcarbazole. 0.1 ml of methanesulphonic acid and 70 ml of pentanol was boiled under reflux at 140° C. while removing the water produced in the reaction by azeotropic distillation. After 5 hours of refluxing the reaction mixture was poured into methanol and the precipitate obtained was filtered off. After drying the product obtained was purified by column chromatography. Yield: 10 g.

Melting point: 191° C.

Preparation of Compound 10

Preparation of Intermediate Compound (A)

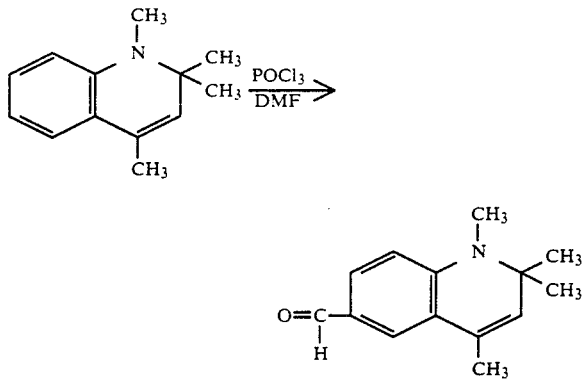

(A)

A mixture of 93.5 g (0.5 mole) of 1,2-dihydro-1,2,2,4-tetramethyl-quinoline and 143 ml of dimethylformamide was heated. 77.4 g (0.5 mole) of phosphorus oxychloride were added dropwise with stirring to the resulting solution over a period of 90 minutes while keeping the temperature at 70°-80° C. The reaction mixture was stirred for 1 h and then poured into 2.5 l of water in which 375 g sodium acetate had been dissolved. The end product was extracted with methylene chloride, the extract dried over anhydrous $MgSO_4$ and the solvent driven off. Compound (A) was then isolated from the residue by distillation.

Yield 65 g. Boiling point: 130°-132° C. at 2 Pa.

A mixture of 42.5 g (0.20 mole) of compound (A), 10.8 g (0.1 mole) of p-phenylenediamine and 0.4 g of p-toluenesulphonic acid in 650 ml of toluene was heated at its boiling point for a period of 3 h and the water formed in the reaction removed by azeotropic distillation. The solvent was removed by evaporation from the resulting red coloured suspension and the residual crude product was purified by boiling in acetonitrile. Yield: 45.3 g. Melting point: 225° C.

Preparation of Compound 11

40.2 g (0.08 mole) of compound 10 was brought into suspension in 250 ml of methanol and 1500 ml of tetrahydrofuran and the mixture heated to 45°-50° C. To said mixture was added portion wise 7.6 g (0.2 mole) of sodium borohydride and the reaction mixture maintained at 55°-60° C. for 5 hours. The yellow-orange solution was concentrated to half its original volume and acetic acid was added to the resulting suspension till it was neutral. The reaction mixture was then diluted with water and the precipitate formed separated by filtration. The crude product was purified by boiling in ethanol.

Yield: 32 g. Melting point: 185° C.

Preparation of compound 13

A mixture of 23.2 g of compound 1, 14.3 g (0.06 mole) of chloranil and 250 ml of ethanol was stirred for 1 h at room temperature (20° C.) . The reaction mixture was poured into water and then made alkaline till pH 12 with 5N NaOH. The precipitate formed was filtered, washed with water till neutral and dried. The crude product was recrystallized from ethanol. Yield: 19.3 g. Melting point :153° C.

Preparation of compound 14

A mixture of 12 g of compound 13, 1.5 g of hydrazine monohydrate, 1 ml of acetic acid and 60 ml of ethanol were refluxed for 14 h. The precipitate formed was separated by filtration and purified chromatically. Yield: 3.2 g. Melting point: 170° C.

Preparation of compound 17 as HBr-salt

Step (1)

39 g (0.169 mole) of 6-ethoxy-1,2,3,4,-tetramethyl-1,2-dihydroquinoline were mixed with 200 ml of 48% wt aqueous HBr and 20 ml of acetic acid and boiled under reflux for 7 h. Thereupon the solvent was removed by evaporation and the residue stirred with 80 ml of acetone. Yield: 42 g. Melting point: 200°-205° C. (decomposition).

Step (2)

7.1 g (0.025 mole) of the compound obtained in step (1) were stirred with 35 ml of dimethylformamide and cooled down to 10° C. To said mixture 2.2 g of 60% wt sodium hydride were added carefully to keep the temperature below 20° C. After 15 minutes stirring 4.7 g of glycoldiester of phenyl sulphonic acid were added and while stirring the reaction mixture was kept at room temperature for 4 h. After drying the remaining solid was recrystallized form glacial acetic acid. Yield: 3.8 g. Melting point: 152° C.

Preparation of polymeric 1,2-dihydroquinoline compound 19

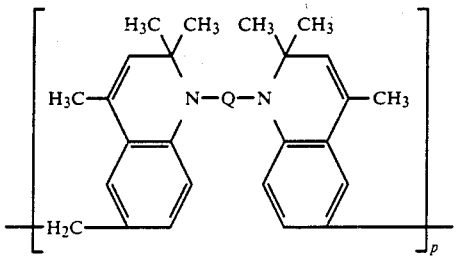

wherein Q is —$CH_2$—$CH_2$—, and p is more than 2.

A mixture of 37.2 g of $N_1$,$N_2$-bis(2,2,4-trimethylquinolinyl)ethane, 7.5 ml of a 40% aqueous formaldehyde solution and 150 ml of acetic acid were boiled under reflux for 6 h. The precipitate formed was separated by filtration and washed with methanol. Yield: 36 g.

According to one embodiment a recording material according to the present invention comprises an electrically conductive support having thereon a single photoconductive recording layer containing at least one 1,2-dihydroquinoline compound according to general formula (I) optionally in combination with a resin binder. Said 1,2-dihydroquinoline compound may be present in combination with one or more charge generating compounds, examples of which have been given hereinbefore.

For the production of a composite layer recording material according to the present invention at least one 1,2-dihydroquinoline compound according to general formula (I) and/or (II) is applied optionally in combination with a resin binder to form a charge transporting layer adhering directly to a charge generating layer on an electrically conductive support. Through the resin binder the charge transporting layer obtains sufficient mechanical strength and obtains or retains sufficient capacity to hold an electrostatic charge for copying purposes. The specific resistivity of the charge transporting layer is preferably not lower than $10^9$ ohm.cm.

The resin binders are selected in view of optimal mechanical strength, adherence to the charge generating layer and favourable electrical properties.

Suitable electronically inactive binder resins for use in the charge transporting layer are e.g. cellulose esters, acrylate and methacrylate resins. e.g. cyanoacrylate resin, polyvinyl chloride, copolymers of vinyl chloride, e.g. copolyvinyl/acetate and copolyvinyl/maleic anhydride. polyester resins, e.g. copolyesters of isophthalic acid and terephthalic acid with glycol, aromatic polycarbonate or polyester carbonate resins.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag. U. Grigo. P. R. Muller and W. Nouvertne in the Encyclopedia of Polymer Science and Engineering. 2nd ed. Vol. II, pages 648-718. (1988) published by Wiley and Sons Inc. and have one or more repeating units within the scope of following general formula (II):

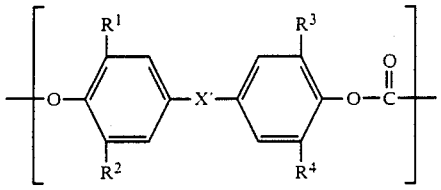

(II)

wherein:

X' represents S, $SO_2$,

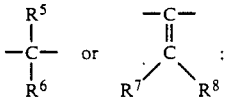

$R^1$, $R^2$, $R^3$, $R^4$, $R^7$and $R^8$ each represents (same or different) hydrogen, halogen, an alkyl group or an aryl group, and $R^5$ and $R^6$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10.000 to 200,000 are preferred. Suitable polycarbonates having such a high molecular weight are sold under the registered trade mark MAKROLON of Farbenfabriken Bayer AG, W-Germany.

MAKROLON CD 2000 (registered trade mark) is a bisphenol A polycarbonate with molecular weight in the range of 12,000 to 25.000 wherein $R^1$=$R^2$=$R^3$=$R^4$=H, X' is $R^5$—C—$R^6$ with $R^5$=$R^6$=$CH_3$.

MAKROLON 5700 (registered trade mark) is a bisphenol A polycarbonate with molecular weight in the range of 50.000 to 120.000 wherein $R^1$=$R^2$=$R^3$=$R^4$=H, X' is $R^5$—C—$R^6$ with $R^5$=$R^6$=$CH_3$.

Bisphenol Z polycarbonate is an aromatic polycarbonate containing recurring units wherein $R^1=R^2=R^3=R^4=H$, X' is

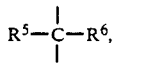

and $R^5$ together with $R^6$ represents the necessary atoms to close a cyclohexane ring.

Further useful binder resins are silicone resins, polystyrene and copolymers of styrene and maleic anhydride and copolymers of butadiene and styrene.

An example of an electronically active resin binder is poly-N-vinylcarbazole or copolymers of N-vinylcarbazole having a N-vinylcarbazole content of at least 40% by weight.

The ratio wherein the charge-transporting 1,2-dihydroquinoline compound and the resin binder are mixed can vary. However, relatively specific limits are imposed, e.g. to avoid crystallization. The content of the 1,2-dihydroquinoline used according to the present invention in a positive charge transport layer is preferably in the range of 30 to 70% by weight with respect to the total weight of said layer. The thickness of the charge transport layer is in the range of 5 to 50 μm, preferably in the range of 5 to 30 μm.

The presence of one or more spectral sensitizing agents can have an advantageous effect on the charge transport. In that connection reference is made to the methine dyes and xanthene dyes described in U.S. Pat. No. 3,832.171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-acceptor groups forming an intermolecular charge transfer complex, i.e. donor-acceptor complex wherein the 1,2-dihydroquinoline represents a donor compound by the presence of its electron donating aliphatically substituted ring nitrogen. Useful compounds having electron-accepting groups are nitrocellulose and aromatic nitro-compounds such as nitrated fluorenone-9 derivatives, nitrated 9-dicyanomethylenefluorenone derivatives, nitrated naphthalenes and nitrated naphthalic acid anhydrides or imide derivatives. The optimum concentration range of said derivatives is such that the molar donor-/acceptor ratio is 10:1 to 1to 1000:1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity and aiding deaeration of the coating compositions and controlling their optical clarity silicone oils may be added to the charge transport layer.

As charge generating compounds for use in a recording material according to the present invention any of the organic pigment dyes belonging to one of the classes a) to n) mentioned hereinbefore may be used. Further examples of pigment dyes useful for photogenerating z positive charge carriers are disclosed in U.S. Pat. No. 4,365,014.

Inorganic substances suited for photogenerating positive charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140.529.

Said photoconductive substances functioning as charge generating compounds may be applied to a support with or without a binding agent. For example, they are coated by vacuum-deposition without binder as described e.g. in U.S. Pat. No. 3,972,717 and 3,973.959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. At least one 1,2-dihydroquinoline compound according to general formulae (I) or (II) may be incorporated into the charge generating layer to aid charge carrier transport in said layer.

The binding agent(s) may be the same as the one(s) used in the charge transport layer which normally provides best adhering contact. In some cases it may be advantageous to use in one or both of said layers a plasticizing agent, e.g. halogenated paraffin, polybiphenyl chloride, dimethylnaphthalene or dibutyl phthalate.

The thickness of the charge producing layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall electrostatically charging. e.g. with corona-device, the charge transporting layer or charge generating layer of the recording material of the present invention, (2) image-wise photo-exposing the charge generating layer of the recording material according to the present invention thereby obtaining a latent electrostatic image.

The photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, N.Y., enlarged and revised edition 1975, p. 50-51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof. For light in the spectral range beyond 800 nm e.g. naphthalocyanines having siloxy groups bonded to the central metal silicon can be used as charge generating substance (ref. published EP-A 0 243 205) .

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The evaluations of electrophotographic properties determined on the recording materials of the following examples relate to the performance of the recording materials in an electrophotographic process with a reusable photoreceptor. The measurements of the performance characteristics were carried out as follows:

The photoconductive recording sheet material was mounted with its conductive backing on an aluminium drum which was earthed and rotated at a circumferential speed of 10 cm/s. The recording material was sequentially charged with a negative corona at a voltage of −4.6 kV operating with a corona current of about 1 μA per cm of corona wire. Subsequently the recording material was exposed (simulating image-wise exposure) with monochromatic light obtained from a monochromator positioned at the circumference of the drum at an angle of 45° with respect to the corona source [see Table 2 for the wavelength (λ) in nm of the applied light and the light dose (I.t) expressed in mJ/m2]. The photo-exposure lasted 200 ms. Thereafter, the exposed recording material passed an electrometer probe positioned at an angle of 180° with respect to the corona source.

After effecting an overall post-exposure with a halogen lamp producing 27.000 mJ/m2 positioned at an angle of 270° with respect to the corona source a new copying cycle was started.

Each measurement relates to 100 copying cycles in which 10 cycles without monochromatic light exposure are alternated with 5 cycles with monochromatic light exposure.

The charging level (CL) is taken as the average charging level over the 90th to 100th cycle, the residual potential (RP) as the residual potential over the 85th to 90th cycle. The % discharge is expressed as:

$$\frac{(CL - RP)}{CL} \times 100,$$

and the fatigue (F) as the difference in residual potential in volts between RP and the average residual potential over the 10th to 15th cycle.

For a given corona voltage, corona current, separating distance of the corona wires to recording surface and drum circumferential speed the charging level CL is only dependent upon the thickness of the charge transport layer and its specific resistivity. In practice CL expressed in volts [V] should be preferably ≧30 d, where d is the thickness in μm of the charge transport layer.

Under the applied exposure conditions, simulating practical copying conditions, and by using a charge transport layer in conjunction with a charge generating layer on the basis of X-phthalocyanine as the charge generating pigment, the % discharge (% DC) should be at least 35% and preferably at least 50%. The fatigue F should preferably not exceed 20 V either negative or positive to maintain a uniform image quality over a large number of copying cycles.

The following examples further illustrate the present invention. All parts, ratios and percentages are by weight unless otherwise stated.

EXAMPLE 1

In the production of a composite layer electrophotographic recording material a 100 μm thick polyester film pre-coated with a vacuum-deposited conductive layer of aluminium was doctor-blade coated with a dispersion of charge generating pigment as defined hereinafter in Table 2 listing also the thickness in μm of the dried charge generating layer, indicated by CGL in said Table 2.

Said dispersion was prepared by mixing for 20 minutes in a pearl mill metal-free X-phthalocyanine (X-Pc), a polyester adhesion-promoting additive DYNAPOL L 206 (registered trade mark), indicated in Table 2 as P2, and an aromatic polycarbonate MAKROLON CD 2000 (registered trade mark), indicated in Table 2 as P1, in the weight percentage given in said Table 2 using dichloromethane as coating solvent. Before coating the dispersion was diluted with sufficient dichloromethane to obtain the required coating viscosity.

The applied charge generating layer was dried for 15 minutes at 80° C. and then the dried charge generating layer was coated using a doctor-blade coater with a filtered solution of a charge transporting 1,2-dihydroquinoline compound (CTC) mentioned by number (No.) in Table 1 hereinbefore and binder MAKROLON CD 2000 (registered trade mark). indicated in Table 2 by P2, applied in the weight percentage given using dichloromethane as coating solvent. The charge transporting layer, indicated in said Table 2 by CTL, was dried for 15 hours at 50° C.

The thickness of the dried charge transporting layer CTL expressed in μm is also mentioned in Table 2 hereinafter.

The characteristics of the thus obtained photoconductive recording material were determined as described above and the results are listed in said Table 2.

TABLE 2

| CTC No. | CGL % X-Pc % P1 % P2 | CTL % CT % P1 | CGL μm | CTL μm | CL [V] | RP [V] | % DI | λ nm | I.t mJ/m2 | F [V] |
|---|---|---|---|---|---|---|---|---|---|---|
| 1 | 50<br>45<br>5 | 50<br>50 | 0.6 | 13.4 | −747 | −327 | 56.2 | 650 | 19.4 | −23 |
| 3 | 50<br>45<br>5 | 50<br>50 | 0.6 | 15.4 | −737 | −337 | 54.3 | 650 | 19.4 | −17 |
| 4 | 50<br>45<br>5 | 50<br>50 | 0.6 | 13.4 | −801 | −329 | 58.9 | 650 | 19.4 | −28 |
| 5 | 50<br>45<br>5 | 50<br>50 | 0.6 | 13.4 | −770 | −269 | 65.1 | 650 | 19.4 | −32 |
| 6 | 50<br>45<br>5 | 40<br>60 | 0.6 | 10.4 | −210 | −82 | 60.9 | 650 | 19.4 | −22 |
| 7 | 50<br>45<br>5 | 50<br>50 | 0.6 | 19.4 | −431 | −322 | 25.3 | 650 | 19.4 | −31 |
| 8 | 50<br>45<br>5 | 50<br>50 | 0.6 | 16.4 | −876 | −400 | 54.3 | 650 | 19.4 | −7 |
| 19 | 50<br>45<br>5 | 50<br>50 | 0.5 | 12.5 | −594 | −335 | 43.6 | 650 | 19.4 | −5 |
| 19 | 50<br>45<br>5 | 100<br>— | 0.5 | 6.5 | −256 | −161 | 37.1 | 650 | 19.4 | −6 |

EXAMPLE 2

A photoconductive recording sheet was produced as described in Example 1 except that the charge generating layer contained 4,10-dibromoanthanthrone (DBA) as charge generating substance instead of the metal-free X-phthalocyanine (X-Pc). Sheet composition and results are listed in Table 3.

TABLE 3

| CTC No. | CGL % DBA % P1 % P2 | CTL % CT % P1 | CGL μm | CTL μm | CL [V] | RP [V] | % DI | λ nm | I.t mJ/m2 | F [V] |
|---|---|---|---|---|---|---|---|---|---|---|
| 1 | 50<br>45<br>5 | 50<br>50 | 0.6 | 19.4 | −873 | −127 | 85.4 | 540 | 26.4 | −9 |
| 4 | 50<br>45<br>5 | 50<br>50 | 0.6 | 14.4 | −752 | −211 | 71.9 | 540 | 10.1 | −11 |
| 5 | 50<br>45<br>5 | 50<br>50 | 0.6 | 15.4 | −779 | −263 | 66.2 | 540 | 10.1 | −17 |

We claim:

1. An electrophotographic recording material which comprises an electrically conductive support having thereon a single photoconductive recording layer containing at least one 1,2-dihydroquinoline compound that corresponds to one of the following general formulae (I) or (II):

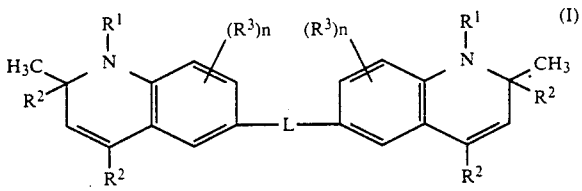

(I)

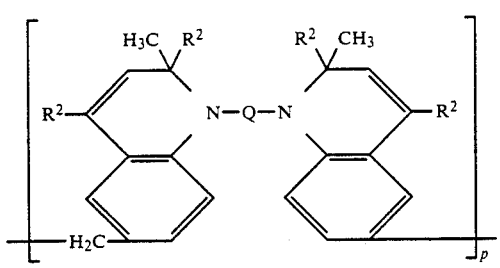

(II)

wherein:

$R^1$ represents hydrogen or a $C_1$-$C_6$ alkyl group in linear or branched form, including said alkyl group carrying one or more substituents selected from the group consisting of aryl, cyano, an ether group, a thioether group, a tertiary amino group, halogen or a heterocyclic group, $R^2$ represents a $C_1$-$C_6$ alkyl group in linear or branched form, an aralkyl group, or an aryl group, $R^3$ represents a $C_1$-$C_4$ alkyl group, an aralkyl group, an aryl group, an alkoxy group or halogen, n is zero, 1 or 2, and L is a chemical bond or a bivalent connecting group represented by the following formula:

$$-(-X-)_k-(-Z-)_l-(-Y-)_m-$$

in which each of X and Y independently from each other represents, $NR^4$, $CHR^4$, CH=N, N=CH, N=N, CH=CH, $CH_2NR^4$, $C{=}NR^4$, $C{=}CHR^4$, O—$CH_2$, O, S, $$C{=}N-\underset{\underset{R^5}{|}}{N}-R^4,\quad C{=}N-N{=}\underset{\underset{R^5}{|}}{C}-R^4,$$

$$\overset{R^4}{\overset{|}{C}}{=}N-N{=}\overset{R^5}{\overset{|}{C}}\quad\text{or}\quad N-\underset{\underset{R^5}{|}}{N}-R^4$$

in which each of $R^4$ and $R^5$ (same or different) represents hydrogen, an alkyl group, an aryl group or a heterocyclic group, including these groups in substituted form, Z represents O, S, C=O, $SO_2$, alkylene, aryl-substituted alkylene, heteryl-substituted alkylene, a cycloalkylene group, an arylene group, a bivalent heterocyclic group or a $C{=}N-N(aryl)_2$ group, and k, l, and m each represent 1, or one or two of them represent zero, Q is an alkylene group, a substituted alkylene group or an alkylene chain interrupted by a bivalent aromatic group, or a bivalent aliphatic group wherein at least two carbon atoms are linked through a hetero-atom selected from the group of oxygen, sulphur or nitrogen wherein nitrogen is substituted with a monovalent hydrocarbon group, and p is a positive integer being at least two.

2. An electrophotographic recording material which comprises an electrically conductive support having thereon a charge generating layer in contiguous relationship with a charge transporting layer, characterized in that said charge transporting layer contains a 1,2-dihydroquinoline compound corresponding to one of the following general formulae (I) or (II):

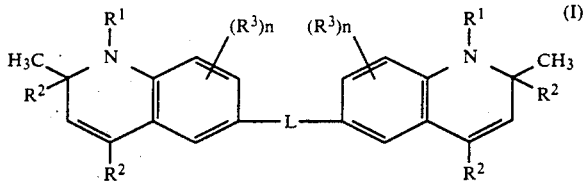

(I)

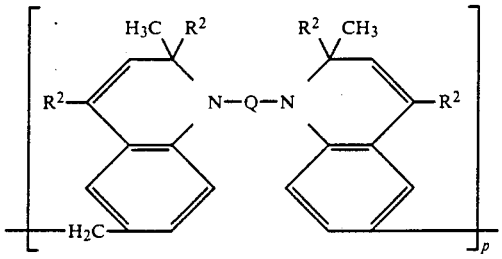

(II)

wherein:

$R^1$ represents hydrogen or a $C_1$-$C_6$ alkyl group in linear or branched form, including said alkyl group carrying one or more substituents selected from the group consisting of aryl, cyano, an ether group, a thioether group, a tertiary amino group, halogen or a heterocyclic group, $R^2$ represents a $C_1$-$C_6$ alkyl group in linear or branched form, an aralkyl group, or an aryl group, $R^3$ represents a $C_1$-$C_4$ alkyl group, an aralkyl group, an aryl group, an alkoxy group or halogen, n is zero, 1 or 2, and L is a chemical bond or a bivalent connecting group represented by the following formula:

$$-(-X-)_k-(-Z-)_l-(-Y-)_m-$$

in which each of X and Y independently from each other represents, $NR^4$, $CHR^4$, CH=N, N=CH, N=N, CH=CH, $CH_2NR^4$, $C{=}NR^4$, $C{=}CHR^4$, O—$CH_2$, O, S, $$C{=}N-\underset{\underset{R^5}{|}}{N}-R^4,\quad C{=}N-N{=}\underset{\underset{R^5}{|}}{C}-R^4,$$

$$\overset{R^4}{\overset{|}{C}}{=}N-N{=}\overset{R^5}{\overset{|}{C}}\ \text{or}\ N-\underset{\underset{R^5}{|}}{N}-R^4$$

in which each of $R^4$ and $R^5$ (same or different) represents hydrogen, an alkyl group, an aryl group or a heterocyclic group, including these groups in substituted form, Z represents O, S, C=O, $SO_2$, alkylene, aryl-substituted alkylene, heteryl-substituted alkylene a cycloalkylene group, an arylene group, a bivalent heterocyclic group or a $C{=}N-N(aryl)_2$ group, and k, l, and m each represent 1, or one or two of them represent zero, Q is an alkylene group, a substituted alkylene group or an alkylene chain interrupted by a bivalent aromatic group, or a bivalent aliphatic group wherein at least two carbon atoms are linked through a hetero-atom selected from the group of oxygen, sulphur or nitrogen wherein nitrogen is substituted with a monovalent hydrocarbon group, and p is a positive integer being at least two.

3. An electrophotographic recording material according to claim 1, wherein said 1,2-dihydroquinoline compound has a melting point of at least 100° C.,

4. An electrophotographic recording material according to claim 1, wherein in the 1,2 -dihydroquinoline compound of general formula (I) $-(X)_k-$ is $-CHR^4-$ and l and m are both zero.

5. An electrophotographic recording material according to claim 1, wherein said 1,2-dihydroquinoline compound is used in admixture with a charge generating compound.

6. An electrophotographic recording material according to claim 2 , wherein said 1,2-dihydroquinoline compound is applied in combination with a resin binder to form a charge transporting layer adhering directly to said charge generating layer with one of the two layers being itself directly applied onto an electrically conductive support.

7. An electrophotographic recording material according to claim 6, wherein the resin binder is selected from the group consisting of a cellulose ester, acrylate or methacrylate resin, polyvinyl chloride, copolymer of vinyl chloride, polyester resin an aromatic polycarbonate resin, an aromatic polyester carbonate resin, silicone resin, polystyrene, a copolymer of styrene and maleic anhydride, a copolymer of butadiene and styrene, poly-N-vinylcarbazole and a copolymer of N-vinylcarbazole having a N-vinylcarbazole content of at least 40% by weight.

8. An electrophotographic recording material according to claim 2, wherein the content of said 1,2-dihydroquinoline in the positive charge transport layer is in the range of 30 to 70% by weight with respect to the total weight of said layer.

9. An electrophotographic recording material according to claim 8, wherein the charge generating layer contains for photo-induced electron-positive hole pair formation an organic substance selected from the group consisting of:

a) perylimides,
b) polynuclear quinones,
c) quinacridones,
d) naphthalene 1,4,5,8 tetracarboxylic acid derived pigments,
e) phthalocyanines,
g) benzothioxanthene-derivatives,
h) perylene 3,4,9,10-tetracarboxylic acid derived pigments,
i) polyazo pigments, and
j) squarilium dyes.
k) polymethine dyes.
l) dyes containing quinazoline groups,
m) triarylmethane dyes, and
n) dyes containing 1,5-diamino-anthraquinone groups.

10. An electrophotographic recording material according to claim 1, wherein the conductive support is made of aluminum, steel, brass or paper or resin material incorporating or being coated with a conductivity enhancing substance, the support being in the form of a foil, web or being part of a drum.

* * * * *